US007040126B2

(12) United States Patent
Edwards, Jr.

(10) Patent No.: US 7,040,126 B2
(45) Date of Patent: May 9, 2006

(54) DISCRIMINATING MECHANISM FOR A PIN TUMBLER LOCK

(75) Inventor: Billy B. Edwards, Jr., Brookfield, WI (US)

(73) Assignee: Master Lock Company, Oak Creek, WI (US)

( * ) Notice: Subject to any disclaimer, the term of this patent is extended or adjusted under 35 U.S.C. 154(b) by 0 days.

(21) Appl. No.: 10/408,955

(22) Filed: Apr. 8, 2003

(65) Prior Publication Data

US 2005/0072199 A1 Apr. 7, 2005

Related U.S. Application Data

(60) Provisional application No. 60/371,262, filed on Apr. 9, 2002, provisional application No. 60/399,231, filed on Jul. 29, 2002.

(51) Int. Cl.
*E05B 19/06* (2006.01)

(52) U.S. Cl. ..... 70/409; 70/358; 70/492; 70/386; 70/419

(58) Field of Classification Search ..... 70/356, 70/358, 492, 493, 375, 386, 405–407, 409, 70/421

See application file for complete search history.

(56) References Cited

U.S. PATENT DOCUMENTS

| | | | |
|---|---|---|---|
| 180,255 | A | 7/1876 | Miller |
| 718,451 | A | 1/1903 | Green |
| 758,024 | A | 4/1904 | Taylor |
| 758,026 | A | 4/1904 | Taylor |
| 851,008 | A | 4/1907 | Jacobson et al. |
| 913,942 | A | 3/1909 | Bodge |
| 2,022,070 | A | 11/1935 | Williams et al. |
| 2,379,040 | A | 6/1945 | Schori |
| 2,525,344 | A | 10/1950 | Garniss |
| 2,857,753 | A | 10/1958 | Biro |
| 3,303,677 | A | 2/1967 | Bauer |
| 3,412,588 | A | 11/1968 | Schwegler |
| 3,413,831 | A | 12/1968 | Crepinsek |
| 3,418,833 | A | 12/1968 | Kerr |
| 3,499,302 | A | 3/1970 | Spain et al. |
| 3,512,382 | A | 5/1970 | Check et al. |
| 3,531,959 | A | 10/1970 | Weber |
| 3,742,744 | A | 7/1973 | Lumme |
| 3,974,670 | A | 8/1976 | Wolter |
| 4,213,316 | A | 7/1980 | Tietz |
| 4,231,242 | A | 11/1980 | Hill et al. |
| 4,343,166 | A | 8/1982 | Hofmann |
| 4,612,787 | A | 9/1986 | Prunbauer et al. |
| 4,998,952 | A | 3/1991 | Hyatt, Jr. et al. |
| 5,050,412 | A | 9/1991 | Errani |
| 5,131,249 | A | 7/1992 | Baden et al. |

(Continued)

FOREIGN PATENT DOCUMENTS

| | | |
|---|---|---|
| CH | 340152 | 9/1959 |

(Continued)

*Primary Examiner*—Suzanne Dino Barrett
(74) *Attorney, Agent, or Firm*—Calfee, Halter, Griswold LLP

(57) ABSTRACT

A pin tumbler lock is provided with one or more additional chambers for housing a secondary locking member for engagement with a portion of a key. The invention also provides a lock system comprising a plurality of locks, each lock including two chambers. The lock system has a potential of N chamber positions to provide a substantial increase in the number of effective unique pin tumbler combinations that can be produced on the same key section or profile by allowing the same pin tumbler combination to be repeated with different locations of these additional chambers.

14 Claims, 8 Drawing Sheets

U.S. PATENT DOCUMENTS

| | | | |
|---|---|---|---|
| 5,176,015 | A | 1/1993 | Sussina |
| 5,181,406 | A | 1/1993 | Wolter |
| 5,475,998 | A | 12/1995 | Raskevicius et al. |
| 5,493,884 | A | 2/1996 | Hinz et al. |
| 5,615,565 | A | 4/1997 | Field |
| 5,617,750 | A | 4/1997 | Preddey |
| 5,819,566 | A | 10/1998 | Eden, Jr. |
| 5,823,029 | A | 10/1998 | Eden, Jr. et al. |
| 5,823,030 | A | 10/1998 | Theriault et al. |
| 6,023,954 | A | 2/2000 | Field |
| 6,105,404 | A | 8/2000 | Field et al. |

FOREIGN PATENT DOCUMENTS

| | | | |
|---|---|---|---|
| DE | 1 260 340 | | 2/1968 |
| DE | 1 765 301 | | 7/1971 |
| DE | 3626552 | A | 8/1988 |
| DE | 19508783 | A | 9/1996 |
| EP | 0971087 | A1 | 1/2000 |
| EP | 0982452 | A | 3/2000 |
| FR | 504473 | | 7/1920 |
| GB | 639171 | | 6/1950 |
| IT | 288628 | | 9/1931 |

DISCRIMINATING MECHANISM FOR A PIN TUMBLER LOCK

CROSS-REFERENCE TO RELATED APPLICATIONS

This application claims the benefit of U.S. provisional application No. 60/371,262 filed on Apr. 9, 2002, and U.S. provisional application No. 60/399,231 filed on Jul. 29, 2002, both applications of which are hereby incorporated by reference.

BACKGROUND OF THE INVENTION

The invention relates to improvements in pin tumbler combination locks. It is known in the prior art to provide a pin tumbler lock system such as disclosed in U.S. Pat. No. 3,742,744. This patent discloses a primary locking system comprising a plurality of pin tumblers and a secondary locking system comprising opposed sets of lateral blocking pins aligned at right angles to the pin tumblers and adapted to engage in grooves in the key. One major disadvantage to this lock system is that the lateral blocking pins must be positioned between the primary pin tumblers. Thus due to the positioning of the lateral blocking pins between the primary pin tumblers, the prior art locking system has a very limited number of combinations. Still further, another disadvantage to this system is that each of the lateral blocking pins and the bores they are received in have a narrow inner portion connected to a larger second portion in order to prevent the pins from fully extending into and blocking the keyway. Thus due to the different diameters and step of each pin and the corresponding bore, additional machining steps are required for the pins and the cylinder plug. Another disadvantage to this system is that due to the length of the pins, the pins have a tendency to tilt in its chamber. Because of this tendency, the key must have a bevel at its tip in order to overcome the additional resistance caused by the pin's tendency to tilt in its chamber. For the foregoing reasons, there is a need for an improved pin tumbler lock with multiple tumbler combinations which overcomes the aforementioned disadvantages.

SUMMARY OF THE INVENTION

The present invention provides in one aspect a lock comprising a shell having a bore formed therein with a plug rotatably mounted within the bore and having a first set of bores aligned with a second set of bores in the shell. A plurality of pin tumblers are slidably disposed in the first set and the second set of bores. A keyway extends in the plug for receiving a key. One or more chambers are formed in the cylinder plug and intersect a portion of the keyway. Two or more ball bearings are mounted within the chamber. The plug further comprises a rib for preventing the ball bearings from blocking the keyway. The key further comprises one or more laterally spaced receptacles positioned for engagement with the ball bearings.

The invention provides in another aspect a lock comprising a shell having a cylindrical bore formed therein. A cylinder plug is rotatably mounted within the cylindrical bore and has a first set of bores aligned with a second set of bores in the shell. A plurality of pin tumblers are slidably disposed in the first set and the second set of bores. A keyway axially extends in the cylinder plug for receiving a key. One or more chambers are formed in the plug and intersect a portion of the keyway. A locking member is mounted within the chamber. The cylinder plug further comprising a rib for preventing the locking member from blocking the keyway. The key further comprises one or more laterally spaced receptacles positioned for communication with the locking member.

These and other features, aspects, and advantages of the present invention will become better understood with reference to the following description and appended claims.

BRIEF DESCRIPTION OF THE DRAWINGS

These and other features, aspects and advantages of the present invention will become better understood with reference to the following description, appended claims, and accompanying drawings wherein:

DETAILED DESCRIPTION OF THE INVENTION

Figure 1:
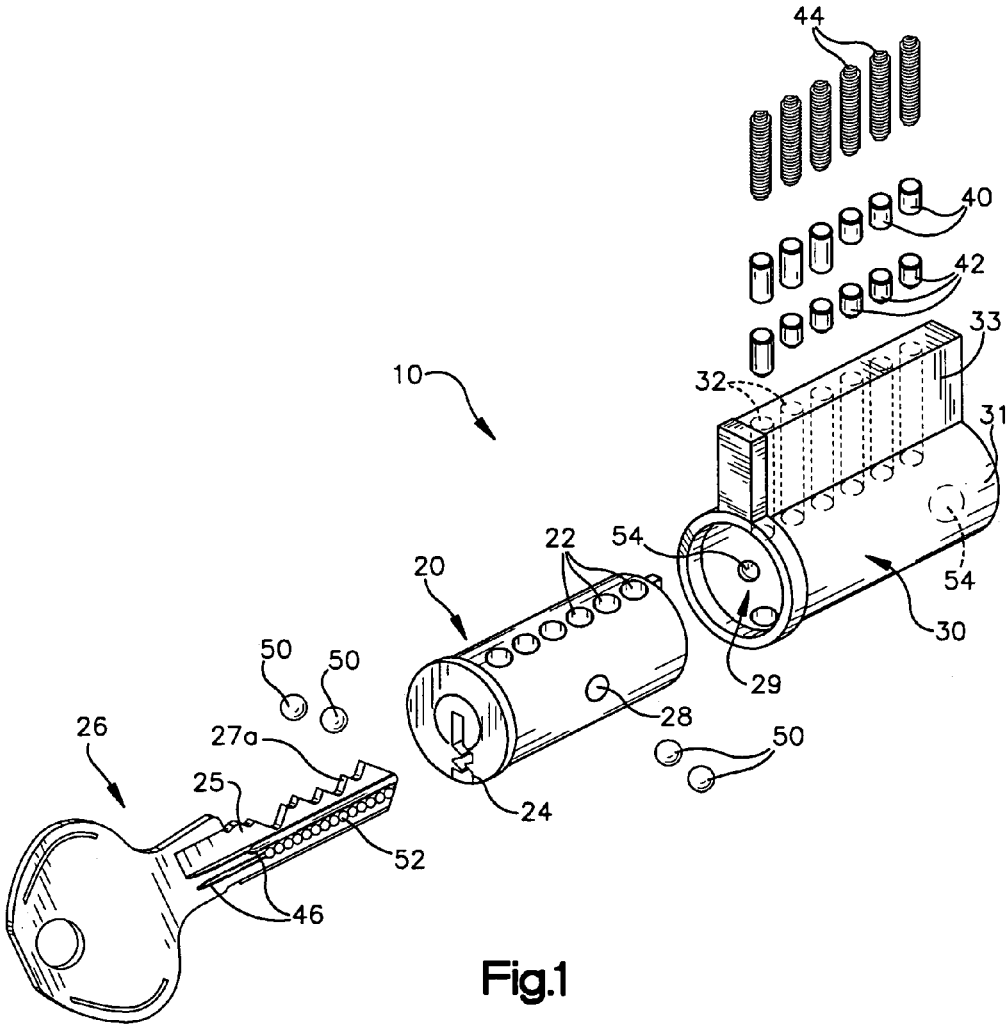
FIG. 1 illustrates a perspective exploded view of a pin tumbler lock and key of the present invention.

As shown in FIG. 1, a lock arrangement comprising a pin tumbler cylinder is shown generally at 10. As described in more detail below, the pin tumbler cylinder plug 20 includes one or more axially spaced pin tumbler bores 22 for housing a plurality of pin tumblers 40,42. The pin tumblers 40,42 are oriented to intersect a keyway 24 and to operatively engage the blade 25 of a key 26, as described in more detail. The cylinder plug 20 further includes one or more chambers 28 which intersect the keyway.

Figure 2:
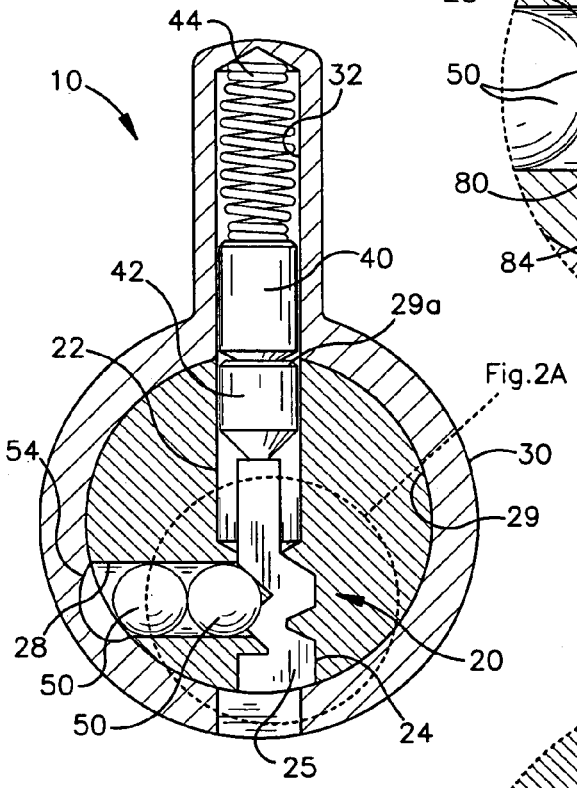
FIGS. 2 and 2*a* illustrate a cross-sectional view of the pin tumbler cylinder lock of FIG. 1 with a key with the correct pin tumbler bitting and a correct receptacle.
Figure 2A:
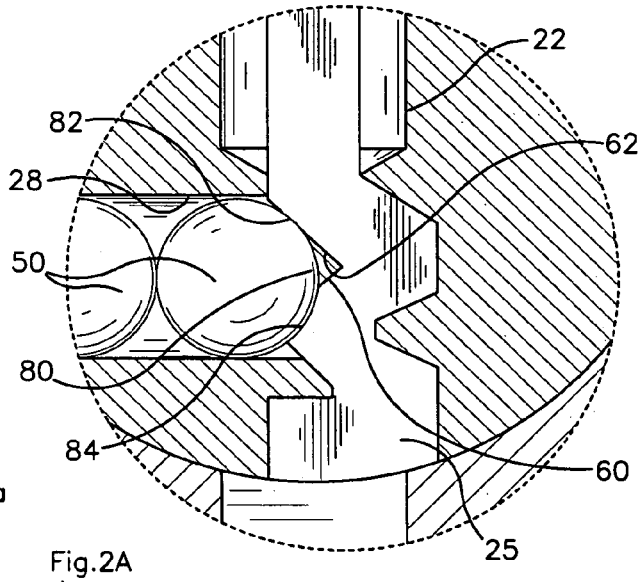
Figure 4:
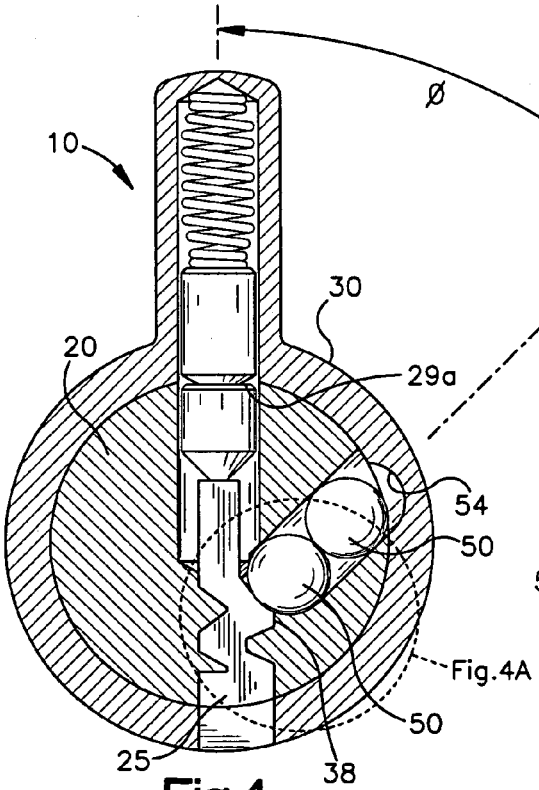
FIGS. 4 and 4*a* illustrate a cross-sectional view of the pin tumbler cylinder lock with the ball bearing chamber at a different orientation than FIG. 2, and shown with a key with the correct pin tumbler bitting and a correct receptacle.
Figure 4A:
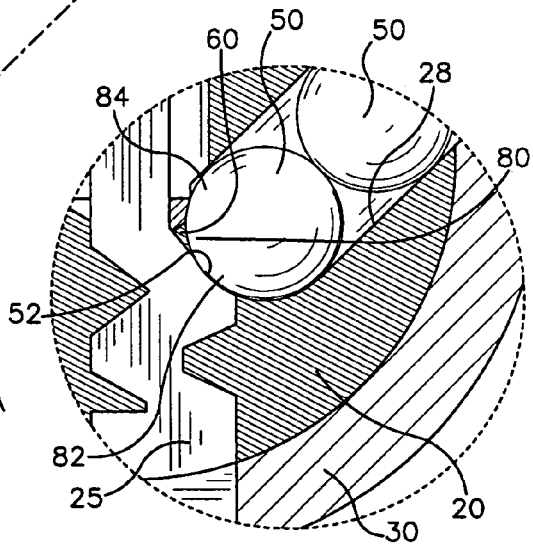
Figure 5:
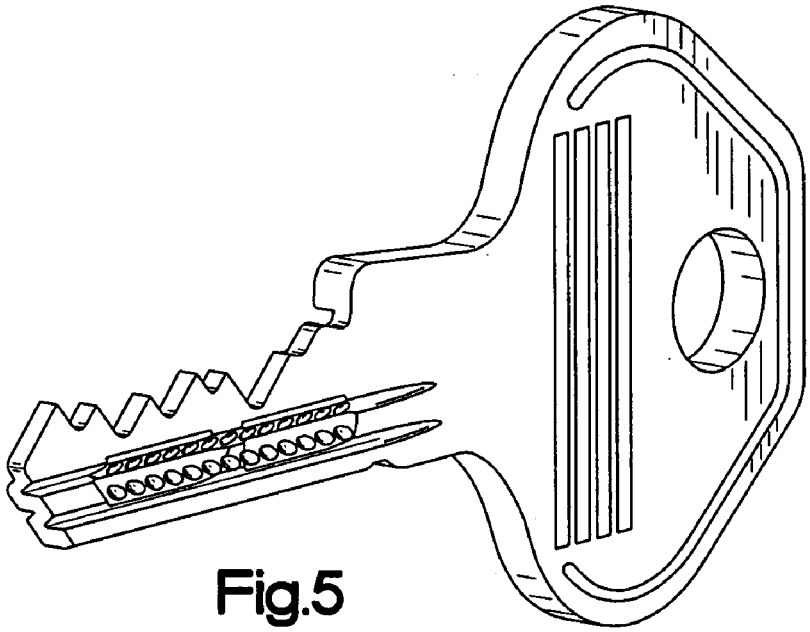
FIG. 5 shows a key of the present invention having all the potential receptacles for mating with the ball bearing chamber orientation of FIG. 2.

As can be seen in FIGS. 2A and 4A, when a proper key is inserted in the cylinder, the proper receptacle 52 or slots 72,73 in the key permit the locking member 50 to enter the key way. When locking member 50 enters the key way it contacts rib 60. As can be seen in FIGS. 2A and 4A, because the locking member is spherically shaped, the locking member 50 contacts the rib 60 at a center portion 80 of the locking member 50. Thus, the locking member 50 is effectively divided by center portion 80, when it is in contact with rib 60, into two different edge portions 82 and 84 that both intersect the key way when a proper key is inserted in the cylinder.

The pin tumbler cylinder plug 20 is rotatably received in a cylindrical bore 29 of a shell 30 for rotation about an axis of the shell. The shell 30 comprises a first cylindrical portion 31 including the cylindrical bore 29 and a second portion 33 extending radially from said first cylindrical portion. The shell second portion 33 includes one or more shell bores 32 aligned with the one or more pin tumbler cylinder bores 22 of the pin tumbler cylinder 20 when the pin tumbler lock is in a first or locking position. As shown in FIG. 1, the shell bores 32 and pin tumbler bores 22 are spaced in parallel planes along the shell longitudinal axis. A plurality of pin tumblers 40,42 are received in respective portions of the bores 32,22. Spring 44 biases the pin tumblers 40,42 inward for mating engagement with a key blade 25.

The keyway 24 of the pin tumbler cylinder plug 20 extends radially inward from the outer surface of the pin tumbler cylinder plug and is aligned in the same plane as the pin tumbler cylinder bores 22. The key blade 25 is received in the keyway 24 for axial movement toward and away from the fully inserted, locking position. The key 26 comprises an edge portion 27 having a bitted surface 27*a* which cooperate with the pin tumblers 40,42 in the conventional manner. Thus when the proper bitted key blade 25 is inserted into the keyway 24, the pin tumblers held in the cylinder plug terminate at the interface 29 of the shell and cylinder plug creating a shear plane so that the pin tumblers do not block rotation of the cylinder plug. Grooves 46 extend over the key sidewalls over its entire inserted length, wherein the grooves conformingly engage aligned sidewalls 48 of the keyway 24 to guide entry of the key blade into the keyway.

Figure 1A:
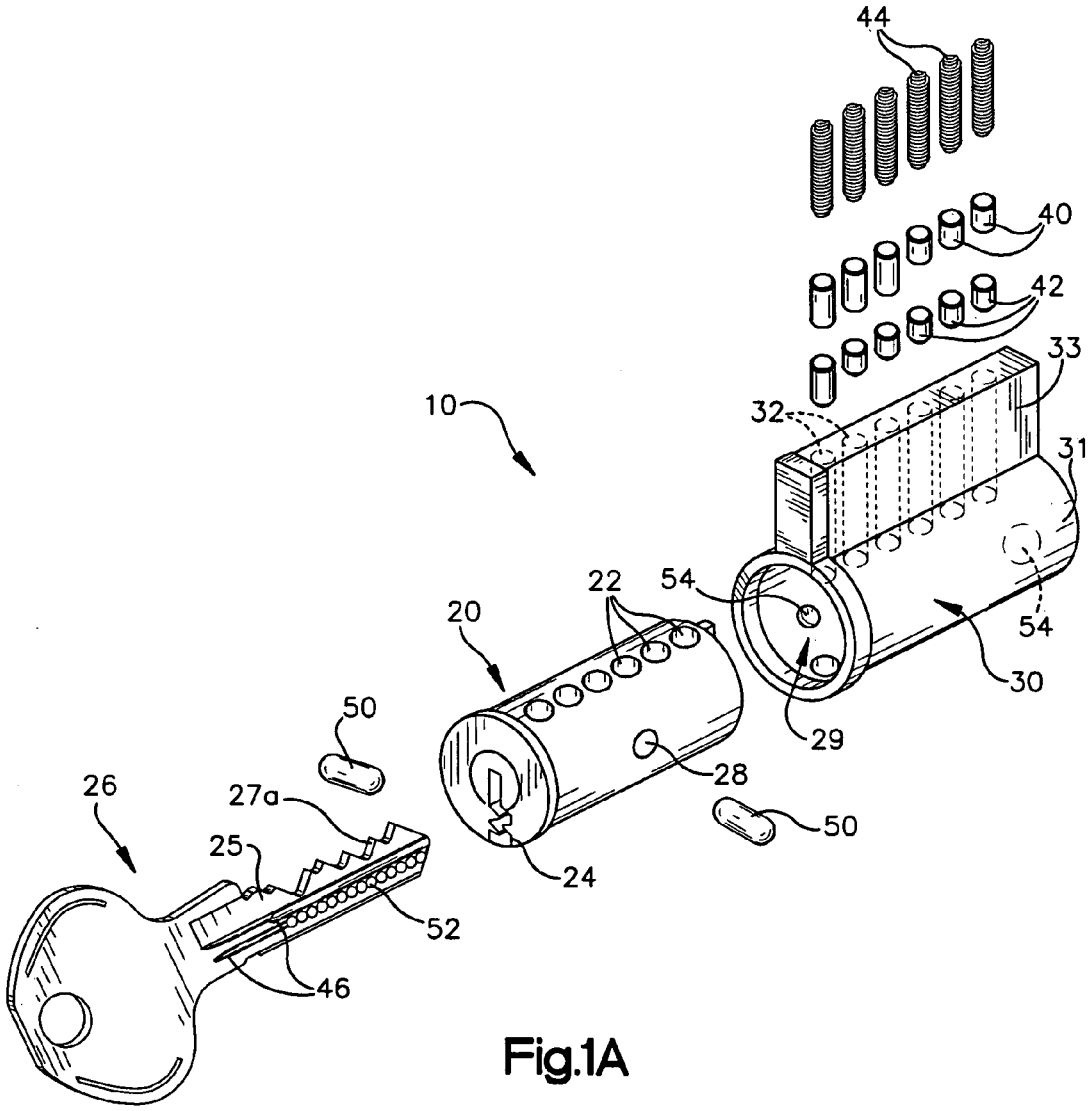
FIG. 1A illustrates an alternate embodiment of a locking member.

The pin tumbler cylinder plug 20 further comprises one or more chambers 28 for housing a locking member 50. Preferably, the locking member is a ball bearing. More preferably, the locking member includes at least two ball bearings. The locking member may also comprise a cylindrical shape preferably having opposed spherically shaped ends FIG. 1A. The locking member may also comprise a pin having opposed spherically shaped ends. However, ball bearings have an advantage over other shaped locking members in that the ball bearings provide significantly less friction, wear and do not require a bevel at the tip of the key to overcome resistance. The chamber 28 is preferably sized to have a depth D equal to or greater than the combined length of the locking member. If ball bearings are utilized, then the chamber depth should preferably be about equal to or greater than the combined diameters of the ball bearings.

The chamber 28 is positioned to intersect a portion of the keyway 24 so that the locking member or ball bearings cammingly engage a receptacle 52 located in a sidewall of the key. The receptacles 52 of the key are preferably arcuately shaped, and thus have a radius of curvature which closely matches the ball bearing curvature. The chamber 28 is additionally aligned with a cavity 54 in the shell interior surface when the cylinder plug 20 is oriented in a locked position. Thus if a fully inserted key has a properly aligned receptacle 52 which aligns with the chamber 28, the locking member will be forced into the key receptacle and chamber by rotational torque applied to the key. If the fully inserted key does not have a receptacle, the locking member will be forced into the cavity 54 and the cylinder plug will be prevented from turning by a portion of the locking member being trapped in the cavity.

Figure 2B:
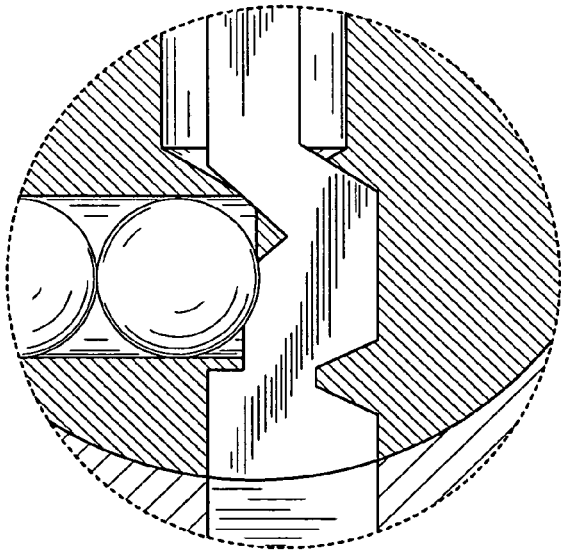
FIG. 2*b* is the same as FIG. 2 except that a different key profile is shown.
Figure 3:
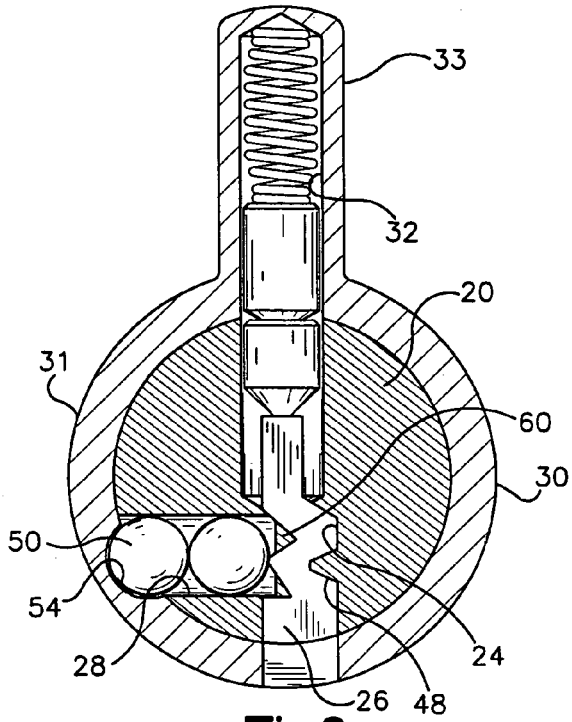
FIG. 3 is the same as FIG. 2 except that a key without the proper receptacle is inserted.

The pin tumbler cylinder plug 20 preferably further includes a rib 60 which extends in a longitudinal direction and is positioned to prevent the locking member from entering and blocking the keyway. Preferably, the rib 60 is located adjacent the keyway and the chamber, and more preferably, is located between the keyway 24 and the chamber 28. See FIGS. 3 and 4 which show different positions of the rib 60. The rib may comprise any desired cross-sectional shape such as a triangle, etc. The key includes a complementary shaped notch 62 which is in mating engagement with the rib 60. Preferably, the notch 62 is a v shaped groove. The key cross-sectional shape is not limited to what is shown in FIGS. 2 and 3, as other shapes would also work for the invention as shown in FIG. 2*b*. However, the key must be shaped to engage the locking member and the rib.

Figure 6:
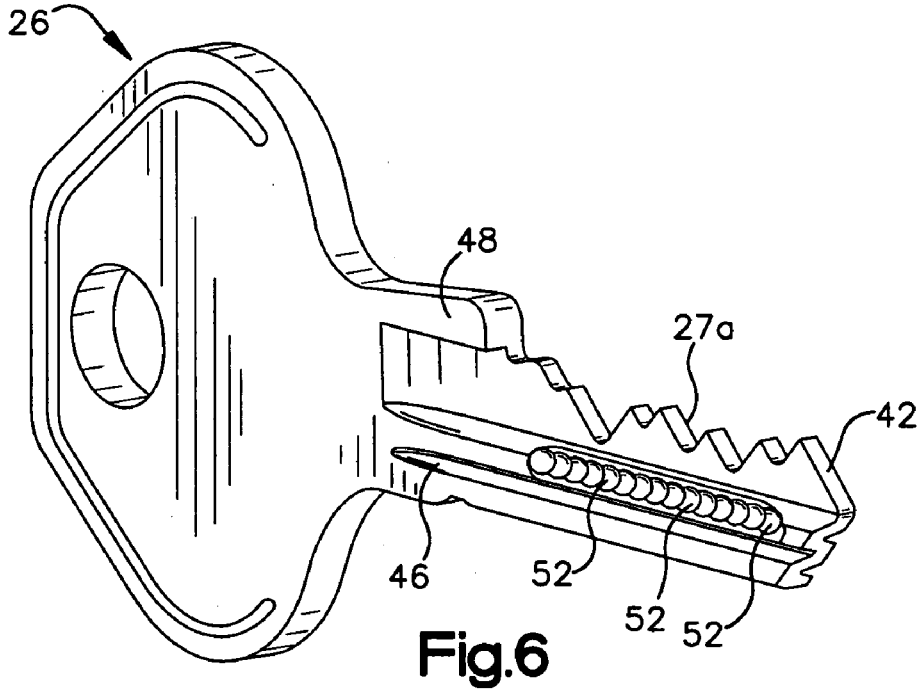
FIG. 6 shows a key having all the potential receptacles for mating with the ball bearing chamber orientation of FIG. 4.

It is preferred that the locking member have a width or diameter less than the diameter of the pin tumblers so that the pin tumblers cannot be trapped in the chamber upon rotation of the cylinder. Further, the chamber 28 need not be oriented perpendicular to the keyway as shown in FIGS. 2 and 3. For example, see FIG. 4 in which the orientation of the chamber intersects a portion of the keyway in a non-orthogonal angle ø. It is preferred that the orientation of the chamber be angularly inclined an angle ø in the range of about 45 degrees to about 135 degrees with respect to the plane of the keyway. With this different orientation of the chamber as shown in FIG. 4, the key receptacles are located on the opposite side of the key on the upper key groove 46 as shown in FIG. 6.

Figure 7A:
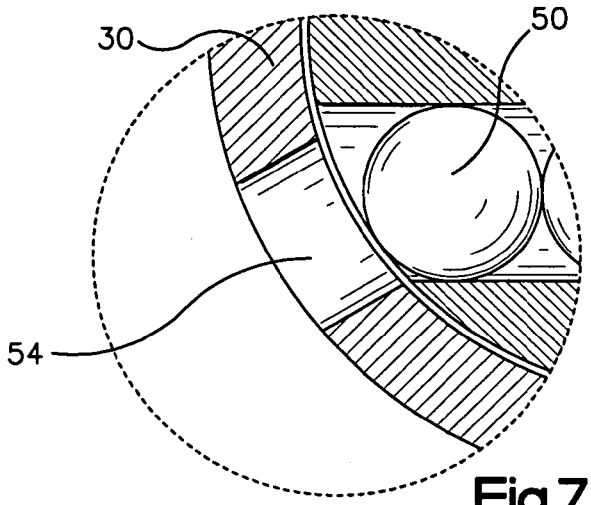
FIGS. 7*a*, 7*b*, and 7*c* show alternate embodiments of the shell cavity.
Figure 7B:
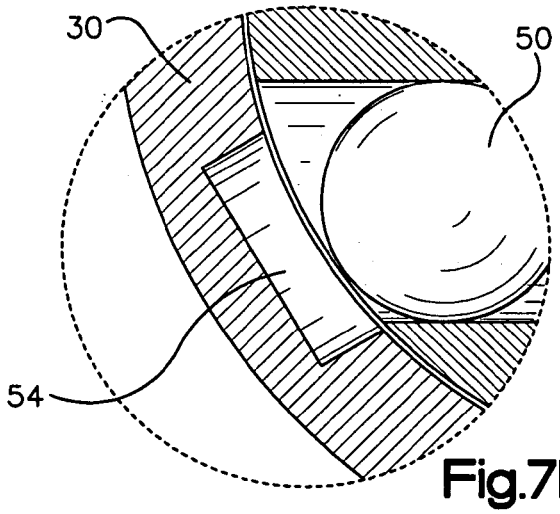
Figure 7C:
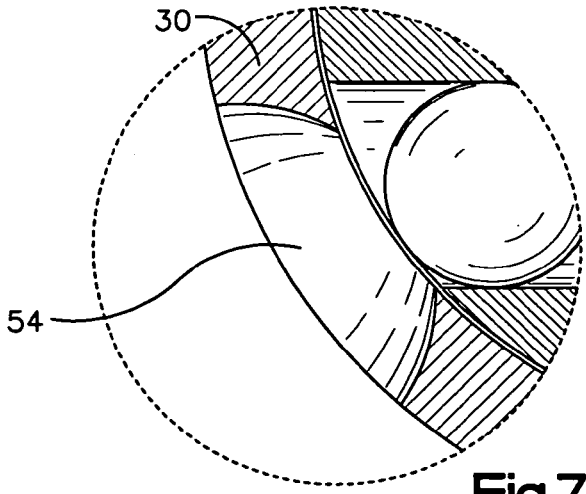
Figure 8:
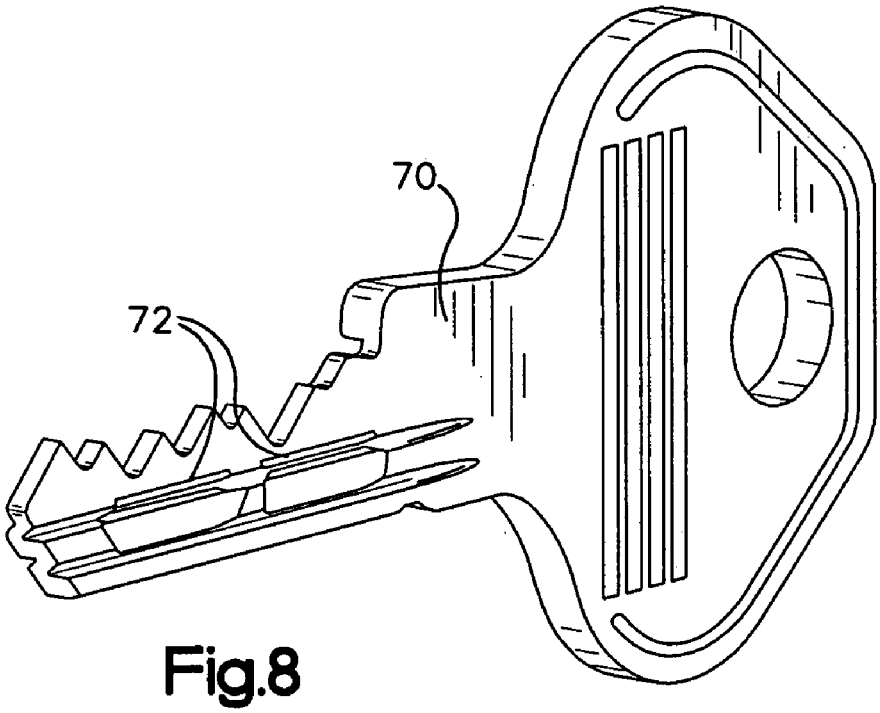
FIGS. 8, 9 and 10 are perspective views of alternate key embodiments of the present invention.

A plurality of chambers 28 are preferably utilized in the cylinder plug 20 of the pin tumbler cylinder 10 and which are uniformly laterally spaced on intervals of the ball bearing radius or larger in the direction of the cylinder axis on either side of the keyway. The shell cavity 54 is preferably sized to have a diameter equal to or greater than the diameter of the ball bearings. The cavity may preferably be dish-shaped or arced as shown in FIG. 2 in discrete locations or along the entire length of the shell. The cavity may also be a cast, broached, drilled or milled hole as shown in FIGS. 7A–7C and which is aligned with the bottom edge of the chamber when in the locked position.

The invention also provides an improved locking system comprising a plurality of locks. Each lock preferably has two chambers with a minimum of two ball bearings in each chamber. For each of the locks in the improved locking system, the chambers 28 are spaced on intervals along the plug cylindrical axis, preferably slightly larger than the radius of the ball bearings. The chambers may be located on one side of the keyway or on both sides of the keyway. The chambers may also be oriented at different angles. Each key in the locking system has a corresponding receptacle which is also spaced on the same intervals as the chambers. If the chambers are located on the same side of the keyway, then it is preferred that adjacent positions not be used because of the close proximity of the ball bearings to each other.

Figure 9:
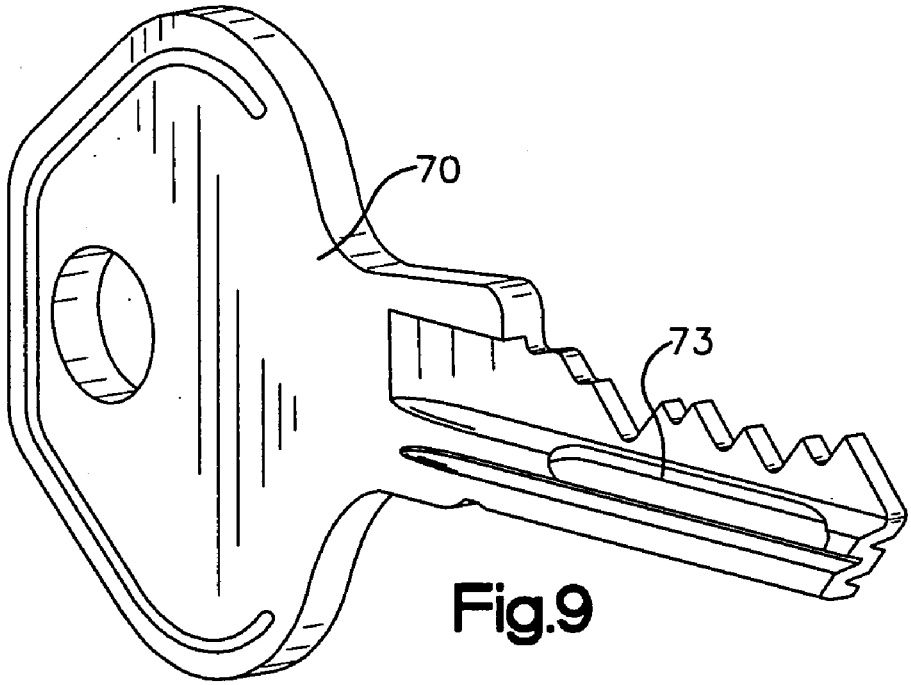
Figure 10:
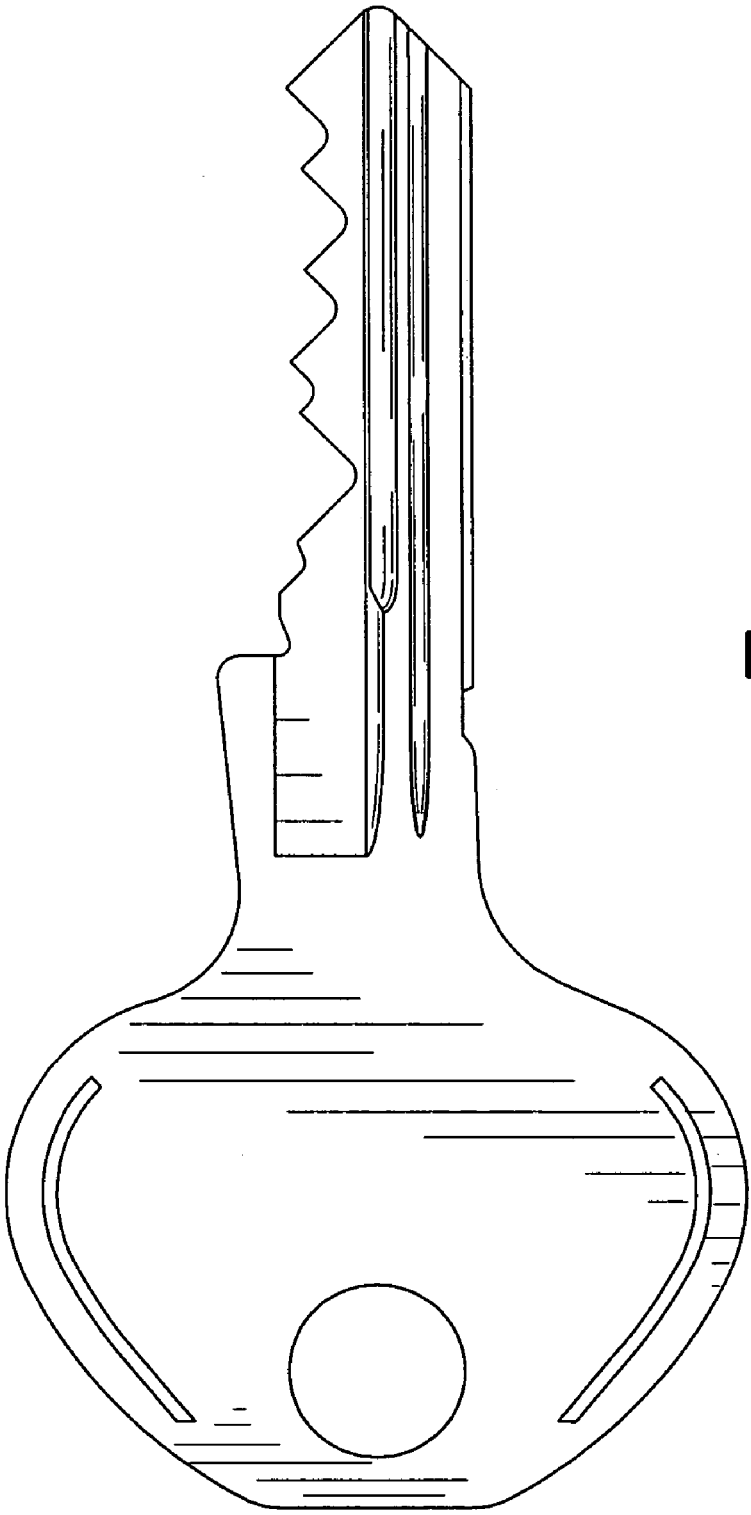
Figure 11:
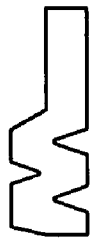
FIG. 11 is an end view of the keys of FIGS. 8–10.

The improved locking system further provides for a service key 70 as shown in FIGS. 9–11. The service key 70 has the same characteristics as described above, except that it has one or more slots 72,73 instead of receptacles 52. The slots 72,73 are positioned to cooperate with the locking member or ball bearings so that they may be partially received within the slot so that the pin tumbler cylinder plug 20 can rotate. The slots may be sized or arranged to service a plurality of lock cylinders which have different combinations or arrangements of the locking member and chambers 28. The length of the slot 72,73 dictates the number of locks which may be serviced.

An example of the locking system of the present invention is as follows. A plurality of locks may be provided with each lock providing for five potential chamber positions located adjacent each other and labeled sequentially A, B, C, D, and E. Each lock would have two chambers. It is preferred that adjacent chamber positions on the same side of the lock not be used. Thus the A and B positions would not be used, however, it would be possible to use A and C on a first lock, chamber positions A and D on a second lock, positions A and E on a third lock. Thus as set forth in Table I below, having only five potential chamber/receptacle positions in a lock system will have the potential of producing six different unique combinations of receptacles on the key.

TABLE I

Example of Chamber Positions Selected for Lock System

| Lock System | Chamber Positions |
|---|---|
| Lock 1 | A and C |
| Lock 2 | A and D |
| Lock 3 | A and E |
| Lock 4 | B and D |
| Lock 5 | B and E |
| Lock 6 | C and E |

For example, in a lock having four standard pin tumblers that use 8 depths of cut there are 4,096 potential depth combinations. The lock system having five chamber locations as described above offers the ability to increase that number six-fold to a total potential of 24,576 unique combinations. Thus by increasing the number of available chamber positions in a lock system, it is possible to increase the potential for different combinations of non-adjacent receptacles.

For example, adding just one more chamber position to the five mentioned above will allow four additional position combinations of A–F, B–F, C–F, and D–F which would increase the number of positional combinations to ten and the overall potential combinations from 4,096 to 40,960 unique combinations. If the lock system having five chamber positions is used in conjunction with a six pin cylinder with the same bitting specifications, the number of unique combinations can be increased to 1,572,864 from 262,144 standard combinations. If six chamber positions are used, the number of possible combinations increases to 2,621,440 unique combinations.

It is also possible to use in combination a plurality of chambers having different orientations (i.e., different ø's). Each different orientation of the chamber would require a mating receptacle on the key. For example it is possible to intermix the chamber configurations as shown in FIGS. 2 and 4. As shown in FIGS. 4 and 6, if thirteen receptacle positions of a first type were utilized in conjunction with thirteen receptacle positions of a second type for the four pin tumbler described above, there would be a total of 301 additional unique arrangements which could be used. Combining the 301 additional arrangements with the 4096 standard combinations for a 4 pin tumbler results in a total of 1,232,896 combinations. If a six pin tumbler is used, a total of 78,905,344 unique combinations may be realized.

Although the present invention has been described in detail with reference to certain preferred embodiments thereof, other embodiments are possible. Therefore, the spirit and scope of the appended claims should not be limited to the description of the preferred embodiment contained herein.

What is claimed is:

1. A lock comprising:

a shell having a bore formed therein;

a plug mounted within the bore and having a first set of bores aligned with a second set of bores in the shell;

a keyway extending in the plug for receiving a key;

a plurality of pin tumblers disposed in the first set and the second set of bores;

one or more chambers formed in the plug and intersecting a portion of the keyway; and one or more locking members disposed within said chamber and aligned with a recess in said plug; and wherein the plug further comprising a rib for preventing said one or more locking members from completely entering the keyway and wherein said rib intersects at least one of said one or more locking members such that a center portion of said at least one of said one or more locking members engages said rib and two different edge portions of said at least one of said one or more locking members intersects with said keyway, wherein said two different edge portions are separated by said center portion.

2. The lock of claim 1 wherein the locking member is comprised of one or more ball bearings.

3. The lock of claim 2 wherein the one or more chambers have a depth equal to or greater than the combined diameters of the one or more ball bearings.

4. The lock of claim 1 wherein the one or more locking members is a pin with spherically shaped ends.

5. The lock of claim 1 wherein the one or more locking members is cylindrically shaped.

6. The lock of claim 1 wherein said rib is located between a chamber and the keyway.

7. The lock of claim 1 wherein one or more chambers intersects a portion of the keyway perpendicularly.

8. A key for operating a lock cylinder that has a keyway and one or more chambers formed in said lock cylinder that intersect said keyway and one or more locking members disposed within said one or more chambers and said cylinder further comprises a rib for preventing said one or more locking members from completely entering the keyway, said key comprising:

a key blade;

a groove in said key blade;

wherein said rib is located in said groove when said key is inserted into said keyway to operate said cylinder; and wherein a center portion of said at least one of said one or more locking members engages said rib when said key operates said lock cylinder and two different edge portions of said at least one of said one or more locking members intersects with said keyway, wherein said two different edge portions are separated by said center portion.

9. The key of claim 8 wherein said groove is longitudinal along said key blade.

10. The key of claim 8 wherein said groove is substantially V-shaped.

11. A key for operating a lock cylinder that has a keyway and one or more chambers formed in said lock cylinder that intersects said keyway and one or more locking members disposed within said one or more chambers and said cylinder further comprises a rib, said key comprising:

a key blade;

a depression in said key blade for receiving said one or more locking members therein when said key is inserted into said keyway to operate said lock; and wherein a center portion of said at least one of said one or more locking members contacts said rib when said key operates said lock cylinder and two different edge portions of said at least one of said one or more locking members intersects with said keyway, wherein said two different edge portions are separated by said center portion.

12. A key for operating a lock cylinder, said cylinder having a keyway and a chamber formed therein that intersects said keyway and a locking member disposed in said chamber and a rib, said key comprising:

a key blade;

a depression in said key blade for receiving said locking member therein when said key is inserted into said keyway;

wherein a center portion of said locking member contacts said rib when said key is inserted in said lock cylinder and two different edge portions of said locking member intersects with said keyway, wherein said two different edge portions are separated by said center portion.

13. The key of claim 11 or 13 wherein said depression is a groove.

14. The key of claim 11 or 12 wherein said depression is a receptacle.

* * * * *